United States Patent [19]

Stancil

[11] 4,327,644

[45] * May 4, 1982

[54] PROJECTILE DEPLOYED CABLE WEAPONS SYSTEM

[75] Inventor: Charles M. Stancil, Springfield, Va.

[73] Assignee: Stahan Corporation, Arlington, Va.

[ * ] Notice: The portion of the term of this patent subsequent to Oct. 13, 1998, has been disclaimed.

[21] Appl. No.: 123,955

[22] Filed: Feb. 25, 1980

Related U.S. Application Data

[63] Continuation-in-part of Ser. No. 34,989, May 10, 1979.

[51] Int. Cl.[3] ..... F42B 13/56

[52] U.S. Cl. ..... 102/504; 87/1 G

[58] Field of Search ..... 102/63, 89 R, 504; 89/1 C, 1 G; 528/331

[56] References Cited

U.S. PATENT DOCUMENTS

| | | | |
|---|---|---|---|
| 1,418,964 | 6/1922 | Norman | 89/1 G |
| 1,757,788 | 5/1930 | West | 102/63 |
| 2,373,364 | 4/1945 | Wellcome | 102/63 |
| 2,396,666 | 3/1946 | Larvick | 89/1 G |
| 2,668,499 | 2/1954 | Mourlaque | 102/63 X |
| 3,600,350 | 8/1971 | Kwolek | 528/331 X |
| 3,975,331 | 8/1976 | Spiewak | 528/331 X |
| 4,133,802 | 1/1979 | Hachiboshi et al. | 528/331 X |
| 4,181,793 | 1/1980 | Musser | 528/331 X |

FOREIGN PATENT DOCUMENTS

| | | | |
|---|---|---|---|
| 166983 | 7/1921 | United Kingdom | 102/63 |

*Primary Examiner*—Peter A. Nelson

*Attorney, Agent, or Firm*—Jenkins, Coffey, Hyland, Badger & Conard

[57] ABSTRACT

A projectile deployed cable weapons system for defeating helicopter rotor systems is disclosed. The deployed cable is intended to settle on the target helicopter from above, and damage is inflicted on the main rotor blade or tail rotor blade of the helicopter by sudden stoppage or castastrophic failure of the contacted rotor system.

A particularly advantageous assemblage for deploying an amount of cable to defeat helicopter rotor systems is also disclosed. The weapons assemblage includes a first cavity for receiving a projectile, a second cavity containing an amount of cable, and a snaring means attached to the first cable and situated with respect to the first cavity so as to intercept the projectile when projected. Most advantageously the assemblage consists of a field container containing both the projectile and cable as a single operating unit to be attached to the muzzle of a mortar cannon of conventional design.

In another embodiment a projectile such as a rocket or shell contains the cable and a submunition. After the projectile is aloft the submunition is fired to carry the cable from submunition in strand form.

12 Claims, 11 Drawing Figures

PROJECTILE DEPLOYED CABLE WEAPONS SYSTEM

This application is a continuation-in-part of U.S. Patent application Ser. No. 34,989 filed May 10, 1979.

BACKGROUND OF THE INVENTION

1. Field of the Invention

This invention is directed to weapons and weapon systems employed by ground-based personnel in defense against helicopter assault. The invention is particularly related to a weapons system intended to entangle the rotor systems of an enemy helicopter by means of a cable descending on the rotor system from above.

2. Description of the Prior Art

The Aviation Safety Board has data available on various types of rotor blade impacts with wires. The wires employed in the production of this data were restrained in the manner of high tension lines and the damage was inflicted on the rotor by the stoppage or catastrophic failure of the rotor system. In some cases, extraneous pieces of communications wire have caused helicopter crashes by becoming entangled in the rotor system. It is well recognized that the rotor system of a helicopter is extremely vulnerable for it constitutes not only the propulsion mechanism but also the lift generating mechanism of the aircraft. If the rotor of the helicopter is defeated while the helicopter is airborne at any significant altitude, the likelihood of safe landing on the part of the helicopter is very low.

The prior art does reveal weapon systems intended to defeat aircraft by means of interaction between a cable and a flight system of that aircraft. In particular, U.S. Pat. No. 2,805,622 to Cammin-Christy discloses a rocket missile having a line attached thereto for interaction with a fixed wing aircraft driven by a propeller. Since most modern fixed wing aircraft of military importance no longer employ propeller-driven engines but rather jet engines and since the wing structure of such aircraft typically employs a dramatic rake angle, the utility of the system shown in the Cammin-Christy patent is very limited. Nonetheless, the basic concept of downing aircraft by interaction with a length of cable is well known in the prior art and the means for deploying the cable other than rocket missiles are known. For example, barrage balloons and the like were employed extensively in the 1930s and 1940s and during the Battle of Britain, bomber crews sometimes threw cables at attaching fighter planes.

In the last six to eight years, dramatic developments in the use of helicopters as assault vehicles and fire support platforms have occurred.Further development of helicopter systems is an integral part of conventional armed force structure as expected. One of the major considerations of any ground-based forces defending against a helicopter-based invasion, is identifying the absolute minimum force necessary to defend against an enemy that has the advantage of numerical superiority as well as ability provided by the helicopter. In that context, it was intended that the present weapons system be one which can be very simply employed by ground troops and that it comprise essentially a minimum adjunct to already existing weapons systems. It was further intended that the present weapons system be usable in the vicinity of friendly troops with little or no hazard to those troops due to accidental overshoot, misfire, or the like.

The problem of close proximity of friendly troops is particularly relevant where the intended site of any helicopter assault operation is specific targets in the rear of a main resistance area such as command and control centers, logistical installations, air defense sites, and bridge heads which an enemy force might wish to secure to the rear of a main defense line so as to ensure a high momentum to any overall assault plan. The rear area target might be only lightly defended in view of its distance from the main line of assault but still might contain a significant population of friendly troops which would prevent the employment of a large amount of incoming firepower. It is further desired that the weapons system be employable against helicopters while at a moderate altitude over a landing zone.

SUMMARY OF THE INVENTION

The present invention employs an assemblage for use with a conventional field deployed weapon such as a rifle, cannon, or mortar. The assemblage can in certain circumstances include the projectile round to be fired by the field deployed weapon. The assemblage has as its major objective deploying an amount of cable in such a fashion as to defeat a helicopter rotor system. The assemblage includes a first wall member which defines a first cavity for receiving a projectile fired by the field deployed weapon. A second wall member joins the first wall member and defines at least a second cavity for receiving an amount of cable to be deployed. An amount of cable is situated within this second cavity. A snaring means is attached to the cable and situated over an opening above the first cavity so as to intercept the projectile when it is fired from the field deployed weapon.

The assemblage preferably includes as a part of the first wall member means for engaging the muzzle of the field deployed weapon. When the weapon is fired, this first wall member is intended to be retained on the muzzle of the weapon and thereafter manually removed prior to firing a subsequent round. Where the weapon selected is a mortar, the first cavity defined by the first wall member can be used as a transporting compartment for the mortar projectile. In this particular embodiment the assemblage constitutes a self-contained round to be used in combination with a conventional mortar cannon.

The assemblage can contain any number of cavities for receiving cables to be deployed. Preferably, two or more cavities exist which are spaced equally around the periphery of the first cavity so as to present the prior projectile with a balanced load during the trajectory path. The cable itself could be any material which would withstand the impact of the rotating helicopter rotor blade. While multi-filament steel cable of approximately $\frac{1}{8}$ inch diameter is believed to be satisfactory, the preferred material would appear to be a synthetic composite of similar tensile strength but much less weight sold under the trademark KEVLAR. KEVLAR is representative of a class of materials typified by aromatic polyamides. Generically, Kevlar is poly-p-benzamide. The fiber is very strong and has a low extensibility and is difficult to break. The fiber has a tenacity of about 7 gm./denier, an extensibility of just under 2 percent and a very high initial modulus of about 300 gm./denier.

When the projectile is fired from the field deployed weapon, the projectile is snared by the snaring means as it exits from the muzzle of the weapon. The snaring means can simply comprise a ring having an inside diameter significantly less than the maximum outside diameter of the outside projectile. More advantageously, the snaring means can comprise an inelastically deformable patch which conformably engages the leading tip of the projectile. This deformable characteristic of the patch leads to a more smooth impulse and thus slightly lower acceleration extremes on the cable thereby ensuring a more smooth deployment of the cable upon firing the weapon. An inelastic shock absorbing means other than the deformable patch could also be employed and connected between the cable and the snaring means. Again, the function of this shock absorbing means would be to absorb the initial shock of impact between the snaring means and the projectile so as to present a more smooth acceleration curve to the cable.

Upon firing the field deployed weapon, whether rifle, cannon, or mortar, there is an initial outflow of gas from the muzzle of the weapon prior to the exit of the projectile itself. It is therefore necessary that apertures exist in the first wall member attached to the muzzle of the weapon so as to permit the escape of this gas without displacement of the snaring means. The apertures are most desirably located such that they are normally in a closed condition except immediately prior to firing the weapon. This is most advantageously achieved by having the assemblage comprise removable end caps or the like which seal the assemblage against adverse environmental conditions. Particularly where the assemblage is to be employed with a mortar, the assemblage may include a release or trigger means which engages the projectile when positioned above the muzzle of the mortar cannon. The release trigger means is manually actuable for releasing the projectile whereupon it falls in a normal manner down the mortar cannon to the bottom thereof where the projectile charge is ignited thereupon deploying the projectile and cable situated within the assemblage.

The cable itself can also comprise a drag increasing means situated at the end of the cable opposite that attached to the snaring means for significantly increasing the drag on the projectile-cable combination when it is fully deployed. Such a drag increasing means may not be necessary if the cable itself is of such a character as to present sufficient drag to properly cause the projectile to deploy the cable in a generally horizontal arc over the landing zone sought to be defended. Since it is most desirable that the cable once deployed over the landing zone descend essentially vertically, the projectile used for deploying the cable most desirably includes a time fuse which causes the destruction of the projectile once the cable is properly deployed over the enemy helicopter.

When the weapon employed, according to the present invention, is a mortar, such as the 81 millimeter M29 or M29A1, then illuminating cartridges such as M301A1 illuminating cartridges such as M301A1 might be employed in combination with time fuse M84 to not only deploy the cable successfully but also to provide night illumination in the event of night attack.

In accordance with the instant invention the weapon may also utilize a projectile such as a rocket or shell in which the cable and a submumision are contained and from which the submunition carries the cable after the projectile is aloft.

Other various features and advantages of a weapons system according to the present invention will become apparent to those skilled in the art upon consideration of the following description of preferred embodiments thereof together with the accompanying figures.

DESCRIPTION OF THE PREFERRED EMBODIMENTS

First Embodiment, Cable Attachment—FIGS. 1-5

Figure 1:
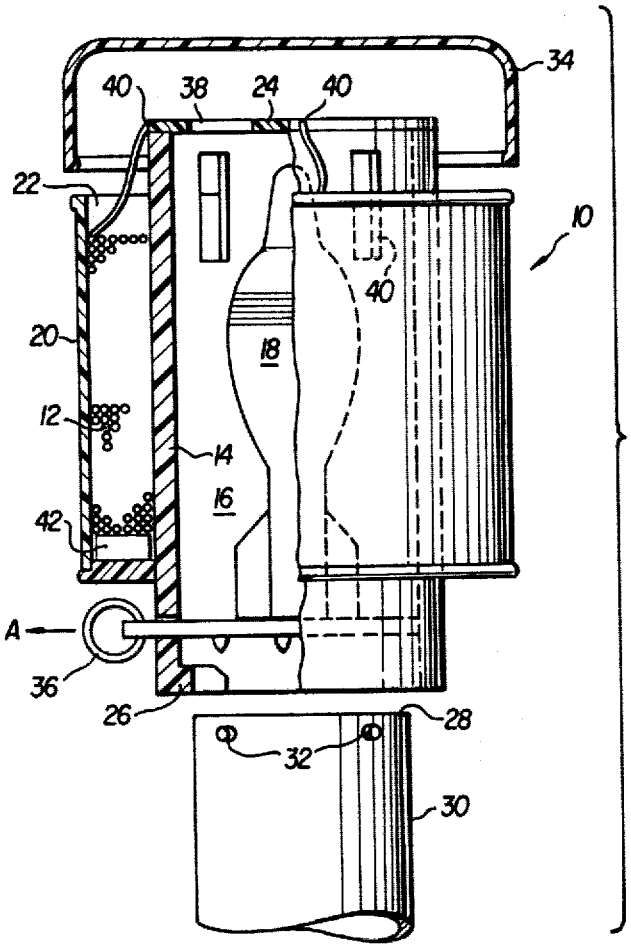
FIG. 1 is an illustration of one embodiment of a weapons assemblage according to the present invention positioned in proximity with the muzzle of a field deployed weapon with which the assemblage might be employed.

A first embodiment of the present invention is illustrated in the accompanying figures wherein similar portions of the illustrated embodiment of the invention carry the same reference numerals in each of the figures. The assemblage 10 is intended to deploy an amount of cable 12 in such a fashion as to defeat a helicopter rotor system. The assemblage 10 comprises generally a first wall member 14 defining a first cavity 16 for receiving a projectile 18. A second wall member 20 is joined to the first wall member 14 and defines at least a second cavity 22 for receiving an amount of cable 12. An amount of cable 12 is situated within the second cavity 22. A snaring means 24 is attached to the amount of cable 12 and situated over the first cavity 16 so as to intercept the projectile 18 when projected.

The first wall member 14 preferably includes means 26 for engaging the muzzle 28 of a field deployed weapon such as a rifle or mortar cannon. While it is intended that the assemblage 10 be employable with field weapons 30 of conventional design without any substantial modification thereof, it is recognized that it may be necessary that the field deployed weapons 30 be modified slightly so as to include cooperating means 32 for cooperating with means 26 of the assemblage 10 to assure retainment of the non-deployed elements of the assemblage 10 after firing of the projectile 18.

Appropriate capping means such as 34 can be conveniently employed and removably secured to at least one end of wall members 14 and/or 20 for sealing the assemblage 10 against adverse conditions of the environment when the assemblage is in an unarmed configuration. In actual use of the assemblage 10, the capping means 34 would preferably be removed prior to firing so as to ensure corect interaction between the projectile 18 and the snaring means 24. A similar capping means to that illustrated in FIG. 1 could be employed on the opposite end of the assemblage 10 although none is there illustrated in FIG. 1. It will be appreciated that this non-illustrated capping means would have to be removed prior to establishing the locking engagement between the muzzle 28 of the field deployed weapon 30 and the assemblage 10.

When the field deployed weapon is a mortar, such as the 60 millimeter model M19, the 81 millimeter mortar model M29, the 4.2 inch mortor model M30, or the like, the mortar round itself 18 could be included in the assemblage 10 as illustrated. Where the assemblage 10 is employed with a breech loading weapon such as a rifle, the assemblage would not contain projectile 18 except during that instant of time when the projectile left the muzzle of the weapon when fired. When used in combination with a mortar in the configuration illustrated in FIG. 1, the assemblage can be seen to constitute a completely self-contained field round inasmuch as the assemblage 10 consists essentially of a deployable aircraft interacting element 12, and means 18 for deploying that element 12 in operative position with respect to the target aircraft. Further, in this configuration, the assemblage 10 can include a release trigger means 36 which engages the projectile 18 prior to firing but when triggered releases the projectile from the first cavity 16 when withdrawn in the direction of arrow A.

When the weapons system is fired and projectile 18 is traveling vertically upward within the barrel of weapon 30, an amount of gas preceeds the projectile 18 which must be vented to the atmosphere. While apertures 38 can be provided in the snaring means 24 to permit the venting of this outward rush of gas, it is also preferred that additional apertures 40 be present in wall 14 so as to prevent premature displacement of the snaring means 24 from the end of the cavity 16. The particular design of the apertures 40 is not believed to be crucial and is believed to be within the design capability of those of ordinary skill in this art.

Figure 2:
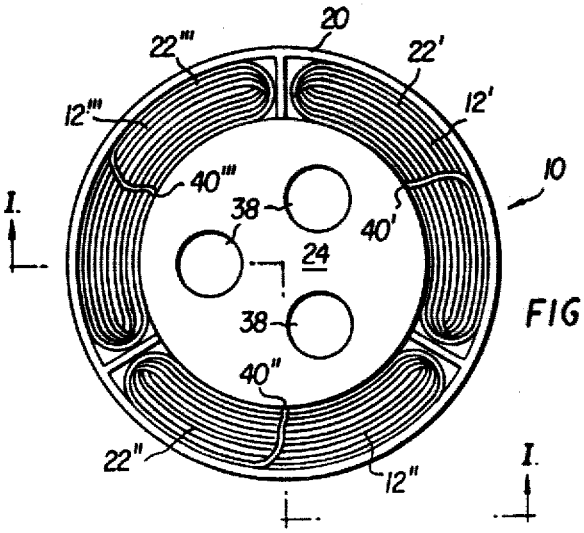
FIG. 2 is a top plan view of the assemblage illustrated in FIG. 1 with the top cap removed and further illustrating the section line employed in FIG. 1.

As illustrated in FIG. 2, the second wall member 20 can define a plurality of cavities 22', 22'', 22'''. In a similar manner, the cavities thus formed will contain a like plurality of cables 12', 12'', and 12'''. A first end 40 of each cable is attached to the snaring means 24. A drag increasing means 42 can be included in the assemblage 10 and connected to the end of the cable 12 opposite that end 40 attached to the snaring means 24. The purpose of the drag increasing means 42 is to significantly increase the drag on the projectile 18-cable 12 combination when the weapon is fully deployed. The cable itself may be made of any material having sufficient tensile strength to resist impact with the rotor blades of a helicopter. Materials which it is believed will satisfy this tensile strength condition yet permit deployment in the fashion are not limited by composition. Those materials which exhibit a high tensile strength comparable to steel wire or strong man-made fibers, such as carbon or polyamides, with tenacity values about 7 gm./denier and low extensibility, less than 5%, and high initial modulus, such as 300 gm./denier are very desirable.

Figure 3:
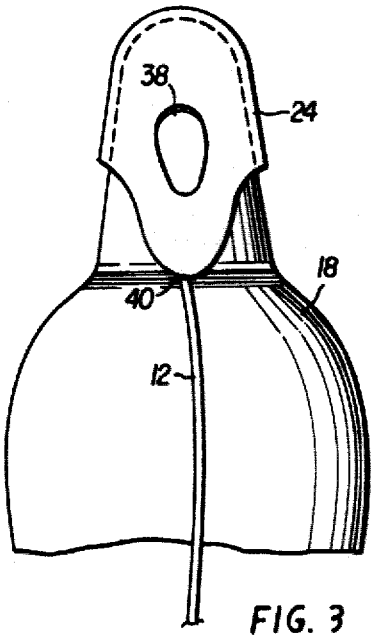
FIG. 3 is an illustration of the inelastic deformation of one embodiment of a snaring means employed in the present invention after that snaring means has been impacted by the projectile.

The snaring means 24 connected to the cable 12 is illustrated in FIGS. 1-3 as an inelastically deformable patch which conformably engages the leading tip of the projectile 18 when projected as shown most dramatically in FIG. 3. This inelastic deformation of the snaring means 24 tends to smooth the abrupt exceleration which would otherwise be experienced by the cable 12.

Figure 5:
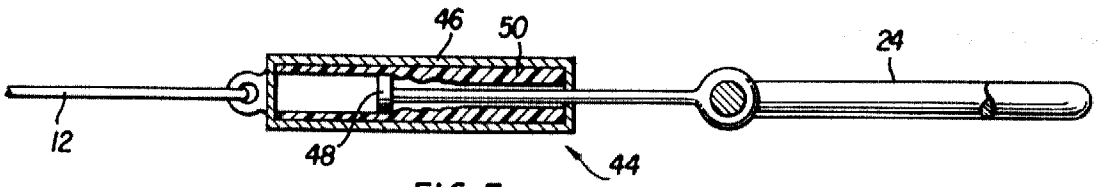
FIG. 5 is an illustration of a shock-absorbing means which can be included between the cable and the snaring means.

The snaring means can also consist of a ring having an inside diameter of the projectile 18 as illustrated in FIG. 5. Other configurations for the snaring means may become apparent upon a study of the functional operation of the device by those skilled in the art. While the snaring means 24 is preferably inelastically deformable, this character is not necessary so long as some other inelastic shock absorbing means 44 is connected between the cable 12 and the snaring means 24 for absorbing the initial shock of impact between the snaring means 24 and the projectile 18 when the weapon is deployed. This inelastic shock absorbing means 44 can comprise a cyclinder 46 and piston 48 arrangement as illustrated in FIG. 5, the cylinder 46 containing an inelastically deformable material 50 which, upon impact between the projectile 18 and the snaring means 24, is inelastically deformed by the piston 48 traveling longitudinally through the cylinder 46.

Figure 4:
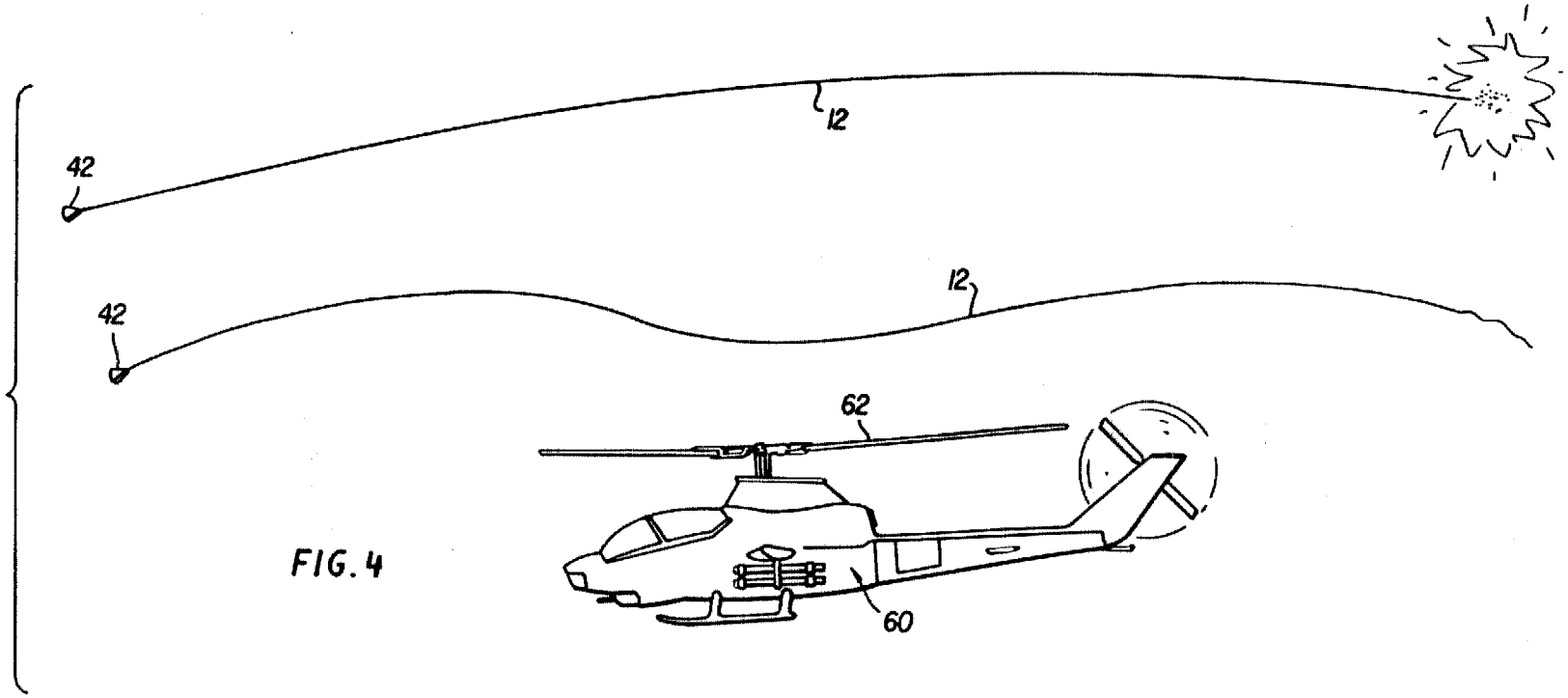
FIG. 4 is a graphic illustration of the deployment of the present cable weapons system with respect to an aircraft target.

It is most desirable that the cables 12 of the present weapon descend in a nearly horizontal fashion over the target aircraft 60 as illustrated in FIG. 4 so as to have the greatest probability of contacting and tangling with the main rotor 62 of the aircraft 60. It is therefore desirable for the cable 12 to have only a minimal or nominal horizontal component of velocity once fully deployed over the landing zone. This can be achieved by including on a terminal end of the cable a drag increasing means 42 which increases the drag once the cable is fully deployed. This can further be accomplished by employing as a projectile 18 one which will disintegrate when the cable 12 is appropriately deployed over the aircraft 60. The drag including means 42 then acts to dramatically slow the horizontal velocity component of the cable 12 and the cable 12 settles to earth in a nearly horizontal arcuate extension. The particular form of the drag enhancing means 42 will depend on the length and weight of the cable initially selected as well as velocity characteristics of the projectile 18 with which the cable is employed.

Figure 7:
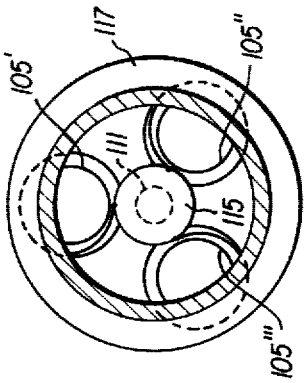
FIG. 7 is a cross sectional view taken along lines 7—7 of FIG. 6.
Figure 6:
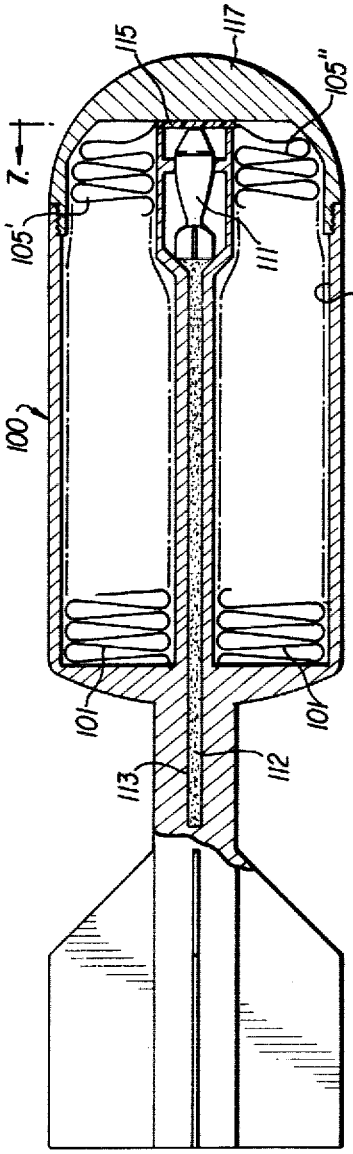
FIG. 6 is an illustration of a second embodiment of a weapons assemblage, according to the instant invention, wherein a shell, such as a mortor shell, is used to carry a packaged snaring cable aloft and a submunition within the shell is used to extend the snaring cable.
Figure 8:
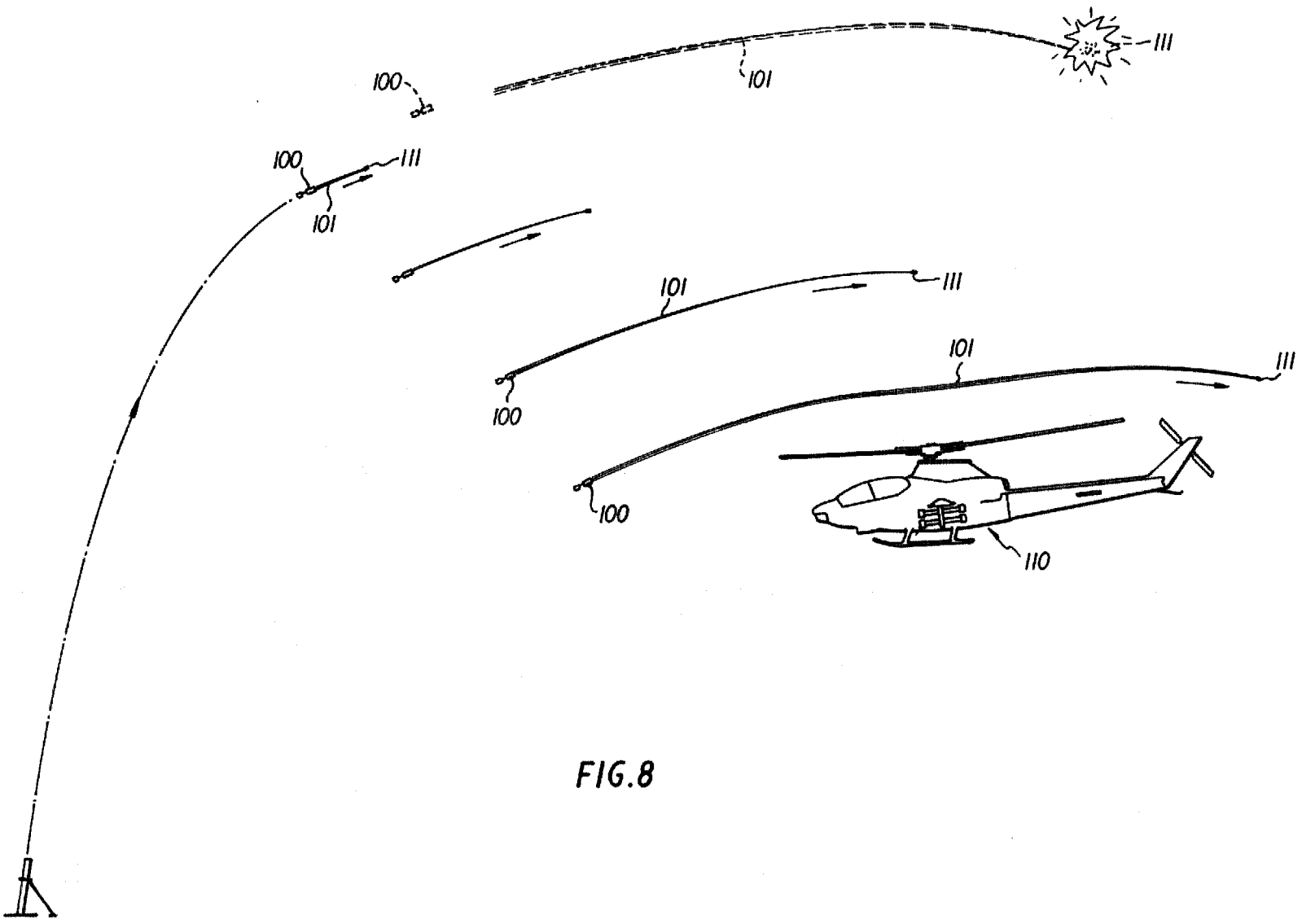
FIG. 8 is a pictorial illustration showing deployment of the weapons assemblage of FIGS. 6 and 7.

Second Embodiment, Cable Contained within Shell—FIGS. 6, 7 and 8

Referring now to FIGS. 6, 7 and 8, there is shown a second embodiment of the invention in which a shell, designated generally by the numeral 100, contains an amount of cable 101 within a cavity 102 in the shell. The cable 101 is preferably packaged in a plurality of coils 105', 105'' and 105''' equally spaced around the axis 106 of the shell 100.

The embodiment of FIGS. 6 and 7 differs from that of FIGS. 1 through 5 in that the cable 101 is carried aloft by the shell in a packaged or coiled configuration instead of being carried aloft in strand form. As is seen in FIG. 7, the cable 101 is projected from the shell 100 preferably after the shell is positioned above a target helicopter 110.

In order to extend the cable 101 from the shell 100, a submunition 111 is carried within the cavity 102 of the shell and propelled therefrom by explosive or rocket means after a time interval determined by a fuse 112 contained within a time charge chamber 113. A capture patch 115 is connected to the ends of the coils 105'-105''' and positioned over and in the path of the submunition 111 so as to pull the cable 101 from the shell 100 in three strands. The shell 100 has a frangable nose 117 which is shattered as the submunition 111 leaves the shell.

In a first embodiment, shown in solid lines in FIG. 8, the submunition 111 does not explode and the ends of the three strands of cable remain secured to the shell 100 and to the submunition so that the cable will drop more rapidly over the helicopter due to the weight of the shell and submunition.

In accordance with a second embodiment of the invention, as shown in dotted lines in FIG. 8, the submunition 111 detonates after extending the three strands of cable 101 far enough to remove the cable completely from the shell 100. Accordingly, the cable 101 extends generally horizontally across the target helicopter 101 and is pulled into the helicopter blades by the downward suction of the helicopter's main rotor.

While a motar shell is disclosed as a prefered embodiment, other types of shells may utilize the aforesetforth principles to carry a cable or cables aloft in order to defeat helicopters.

The same considerations as to the structure and functions of capture patches and cables set forth in the description of the embodiment of FIGS. 1-5 apply to the embodiment of FIGS. 6-8.

Figure 9:
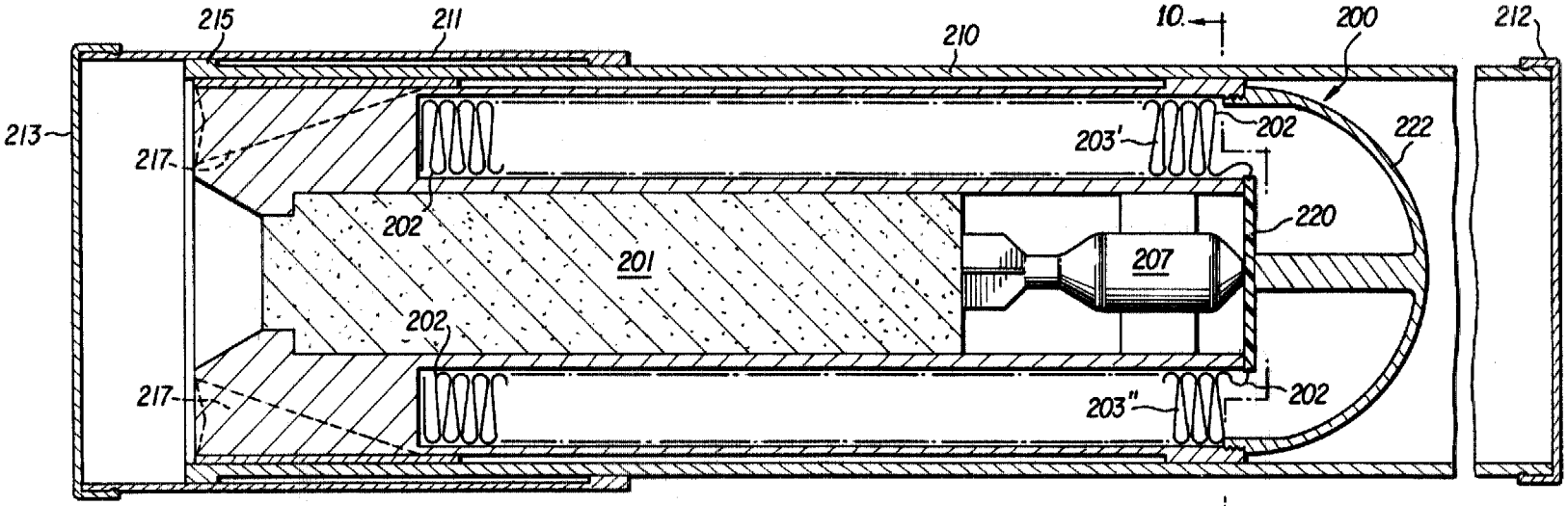
FIG. 9 is an illustration of a third embodiment of a weapons assemblage, according to the instant invention, wherein a rocket is used to carry a packaged snaring cable aloft and a submunition within the rocket is used to thereafter extend the snaring cable.
Figure 10:
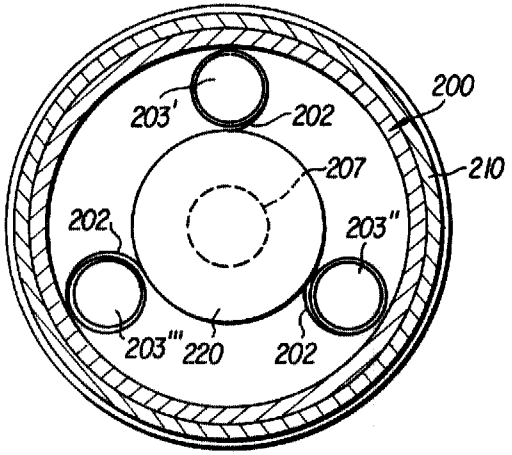
FIG. 10 is a cross section taken on lines 10—10 of FIG. 9.
Figure 11:
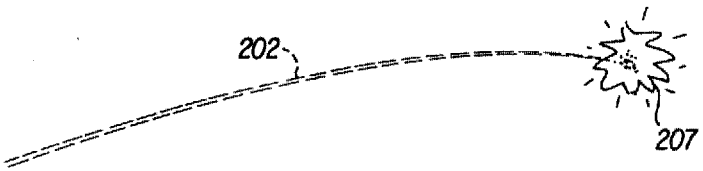
FIG. 11 is a pictorial illustration showing deployment of the weapon assemblage of FIG. 8.
Figure 11:
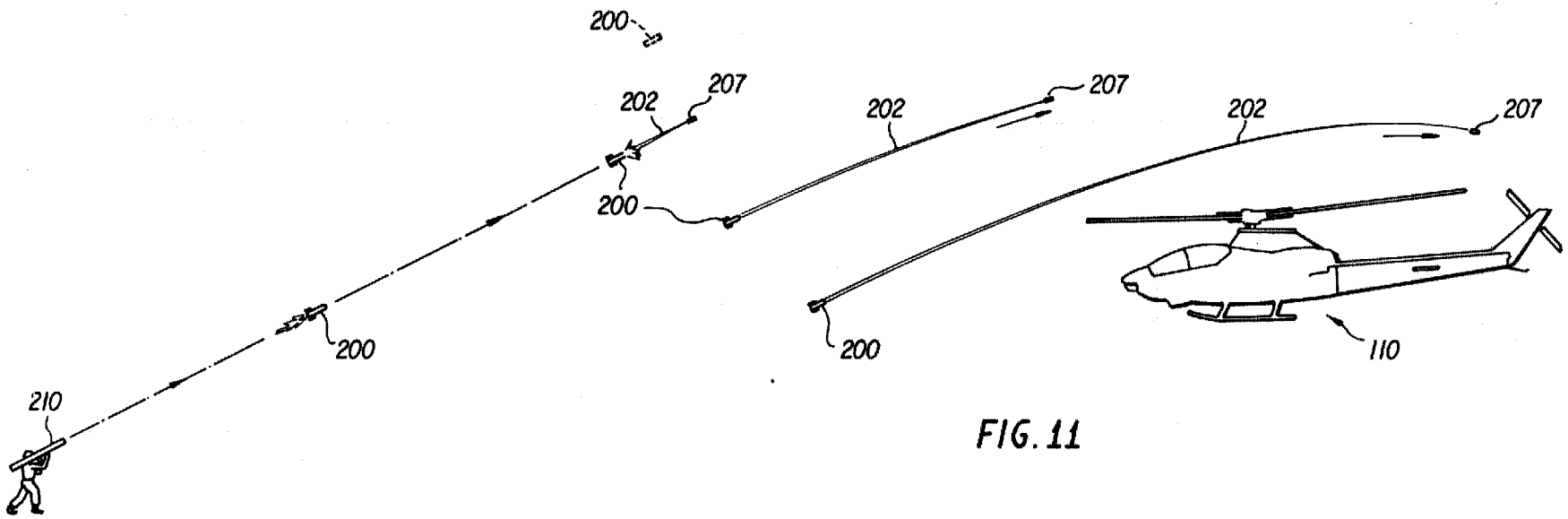

Third Embodiment, Rocket Projectile Containing Snare Package—FIGS. 9, 10 and 11

Referring now to FIGS. 9, 10 and 11 wherein the third embodiment of the invention is set forth, a rocket designated generally by the numeral 200, is propelled aloft by a propellent 201 contained therein and carries aloft three strands of cable 202 packaged in a plurality of coils 203', 203'' and 203'''. As with the shell projectile 100 of FIGS. 6-8, the rocket projectile 200 includes a submunition 207 which is propelled from the rocket 200 to unwind the strands of cable 202 from the coils 203', 203'' and 203'''.

In a prefered embodiment, the rocket 200 is shoulder fired although it may be also fired from a vehicle or a stationary position. The rocket 200 is carried in a launching tube 210 which includes an extension 211 at the rear end thereof to lengthen the tube and a removable front and rear covers 212 and 213, respectively. The extension tube 211 locks to the tube 210 via a conventional locking lug 215. The rocket 200 also includes a plurality of folding fins 217 disposed about its aft end.

As with the other embodiments of this invention, the submunition 207 is aligned behind a capture patch 220 that is attached to ends of the coils 203', 203'' and 203'''. A frangable nose 222 covers the front end of the rocket 200 and is shattered upon launching the submunition 207 so that the cables 202 are pulled from the rocket 200 in strand form by the submunition.

In one embodiment shown in solid lines in FIG. 10, the cable 202 remains attached to the rocket 200 and to the submunition 207, whereby the cable is extended over the helicopter with the relatively large weight of the casing and submunition at each end so as to drop fairly rapidly and drape over the helicopter to snare the rotors.

In another embodiment shown in dotted lines in FIG. 10, the cables 202 are pulled free of the rocket 200 and the submunition 207 is exploded to release the cables so as to in effect drift into the helicopter rotors due to the downward suction of the main rotor.

The same considerations as to the structure and function of capture patches and cable set forth in the description of the embodiment of FIGS. 1-5 apply to the embodiment of FIGS. 9-11.

Other variations, features, and advantages of the present invention are believed to become apparent to those of ordinary skill in the art from a review of this disclosure. This discussion and illustration of prefered embodiments is intended to be examplary of the invention and not all inclusive, the invention being defined by the apended claims.

I claim:

1. An assemblage for deploying an amount of cable to defeat a helicopter rotor system, the assemblage comprising:

(a) a projectile for firing toward a helicopter, the projectile having a cavity therein;

(b) cable means situated within the cavity;

(c) a submunition situated within the cavity;

(d) means for projecting the submunition from the cavity a predetermined time after firing the projectile, and (e) inelastically deformable snaring means for connecting the submunition to the cable means to carry the cable means from the cavity whereby the cable means overlies the helicopter for entanglement with a rotor thereof.

2. The assemblage of claim 1 wherein the cable means is packaged in a coil.

3. The assemblage of claim 1 wherein the cable means is arranged in separate packages around the submunition.

4. The assemblage of claim 3 wherein the snaring means for connecting the submunition to the cable means also connects the cable packages to one another.

5. The assemblage of claim 4 wherein the submunition carries the cable means in strand form from the projectile.

6. The assemblage of claim 5 wherein the cable means is retained at one end to the projectile after the cable means is extended from the projectile.

7. The assemblage of claim 5 wherein the submunition includes means for separating the submunition from the cable means and the cable means from the projectile after the cable has been extended by the flight of the submunition.

8. The assemblage of claim 5 wherein the submunition includes an explosive and a fuse which ignites the explosive a predetermined time after separation of the submunition from the projectile.

9. The assemblage of claims 1, 2, 3, 4, 5, 6, 7 or 8 wherein the projectile carries its own propellant in flight and is a rocket.

10. The assemblage of claims 1, 2, 3, 4, 5, 6, 7 or 8 wherein the projectile separates from its propellant and is a shell round.

11. The assemblage of claims 1, 2, 3, 4, 5, 6, 7 or 8 wherein the projectile includes a frangible nose through which the submunition and cable means pass as the cable means is extended.

12. The assemblage of claims 1, 2, 3, 4, 5, 6, 7 or 8 wherein the cable means consists essentially of a preselected length of poly-p-benzamide fiber.

* * * * *